United States Patent [19]

Hayashi

[11] Patent Number: 4,594,011

[45] Date of Patent: Jun. 10, 1986

[54] INK CARTRIDGE CHANGEOVER DEVICE IN AN INK RIBBON CASSETTE FOR A PRINTER

[75] Inventor: Mikio Hayashi, Tokyo, Japan

[73] Assignee: Seikosha Co., Ltd., Tokyo, Japan

[21] Appl. No.: 561,730

[22] Filed: Dec. 15, 1983

[30] Foreign Application Priority Data

Dec. 17, 1982 [JP] Japan ..... 57-191018

[51] Int. Cl.[4] ..... B41J 31/16; B41J 32/02

[52] U.S. Cl. ..... 400/200; 400/208; 400/196.1; 24/615

[58] Field of Search ..... 400/196, 196.1, 208, 400/198, 199, 200; 24/615

[56] References Cited

U.S. PATENT DOCUMENTS

| | | | |
|---|---|---|---|
| 1,601,359 | 9/1926 | Harrington | 24/615 |
| 2,292,429 | 8/1942 | Buick | 24/615 |
| 3,072,938 | 1/1963 | Phanenf | 24/615 |
| 4,150,464 | 4/1979 | Tracy | 24/615 |
| 4,153,378 | 5/1979 | Scherrer et al. | 400/200 |
| 4,273,456 | 6/1981 | Haftmann | 400/196.1 |
| 4,322,172 | 3/1982 | Furrow | 400/208 |

*Primary Examiner*—William Pieprz

*Attorney, Agent, or Firm*—Robert E. Burns; Emmanuel J. Lobato; Bruce L. Adams

[57] ABSTRACT

An ink ribbon cassette for a printer includes a casing defined by a top wall and a bottom wall, at least one ink cartridge disposed slidably in the casing, a transfer roller disposed in the casing for transferring ink from the ink cartridge to an ink ribbon, and a spring urges the ink cartridge toward the transfer roller. The top wall has a slot extending radially relative to the transfer roller. A first projection is formed on the ink cartridge, and extends upwardly through the slot. A pair of elastic levers extend from the first projection radially relative to the transfer roller, and are disposed in the slot. Each lever has a second projection formed adjacent to an end thereof remote from the first projection. A pair of third projections are provided on the opposite edges of the slot for engaging the second projections to maintain the ink cartridge in its retracted position away from the transfer roller. A fourth projection is formed on the end of each lever, and projects above the slot by a height which is sufficient to enable the disengagement of the second projections from the third projections when the fourth projections are depressed to permit the spring to move the ink cartridge into engagement with the transfer roller.

4 Claims, 4 Drawing Figures

INK CARTRIDGE CHANGEOVER DEVICE IN AN INK RIBBON CASSETTE FOR A PRINTER

BACKGROUND OF THE INVENTION

1. Field of the Invention:

This invention relates to an ink ribbon cassette for a printer of the type in which ink is supplied from an ink cartridge to an ink ribbon by a transfer roller. More particularly, it is concerned with an ink cartridge changeover device for moving an ink cartridge into contact with the transfer roller, or away therefrom.

2. Description of the Prior Art:

There is known an ink ribbon cassette of the type in which ink is supplied from an ink cartridge to an ink ribbon by a transfer roller. There is also known an ink ribbon cassette of the type in which an ink cartridge is movable into contact with the transfer roller, and away therefrom. This changeover of the cartridge position, however, requires a complicated mechanism including a lot of parts, such as a changeover lever.

SUMMARY OF THE INVENTION

It is an object of this invention to provide an ink ribbon cassette in which the position of an ink cartridge can be changed by a simple mechanism. This object is attained by the invention. The device is easy to operate, and requires only a small space for installation so that the cassette may be small in size.

DETAILED DESCRIPTION OF THE INVENTION

Figure 1:
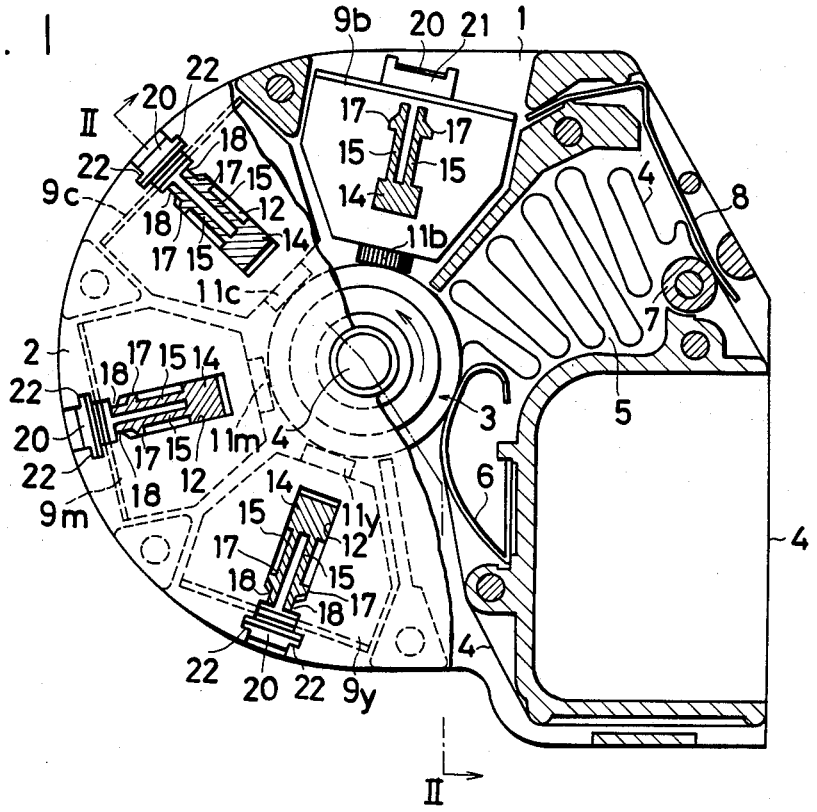
FIG. 1 is a top plan view, partly in section, of a device embodying this invention.
Figure 2:
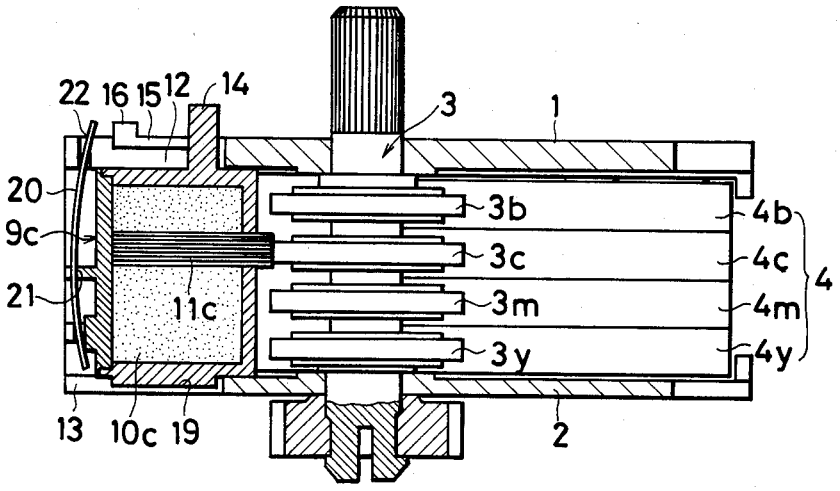
FIG. 2 is a sectional view taken along the line II—II of FIG. 1.

Referring to FIGS. 1 and 2 of the drawings, an ink ribbon cassette embodying this invention comprises a casing having a top wall 1 and a bottom wall 2, and an ink transfer roller 3 supported rotatably between the walls 1 and 2. The casing has a ribbon storage chamber 5 in which an endless ink ribbon 4 folded in zigzag form is stored. The ink ribbon 4 has a portion lying outside the casing. The ink ribbon 4 is held against the transfer roller 3 by a spring 6, and movable into, and out of the ribbon storage chamber 5 if the roller 3 is rotated counterclockwise as viewed in FIG. 1. A pass roller 7 is provided in the vicinity of the ribbon outlet of the chamber 5, and the ink ribbon 4 is held against the roller 7 by a spring 8. Thus, the ink ribbon 4 leaving the chamber 5 is frictionally held against the roller 7, and kept under tension.

The ink ribbon 4 is a multicolor ink ribbon having four longitudinally extending parallel zones **4*b*, 4*c*, 4*m* and 4*y* of black, cyan, magenta and yellow colors, respectively. The transfer roller 3 has four ink transfer surfaces 3*b*, 3*c*, 3*m* and 3*y* contacting the four zones 4*b*, 4*c*, 4*m* and 4*y*, respectively, of the ink ribbon 4, as shown in FIG. 2. Four corresponding ink cartridges 9*b*, 9*c*, 9*m* and 9*y* are radially disposed about the transfer roller 3. Each ink cartridge has an ink pad containing a black, cyan, magenta or yellow ink. FIG. 2 shows by way of example an ink pad 10*c* containing a cyan ink. Each ink cartridge also has an ink delivery member projecting toward the transfer roller 3. The ink delivery members 11*b*, 11*c*, 11*m* and 11*y* of the four ink cartridges face the ink transfer surfaces 3*b*, 3*c*, 3*m* and 3*y*, respectively, of the transfer roller 3**.

Figure 3:
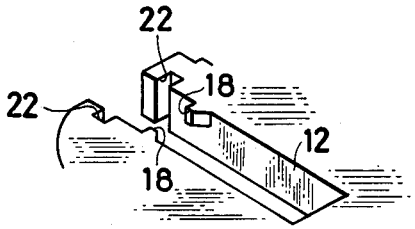
FIG. 3 is a fragmentary enlarged perspective view of a portion of the device shown in FIG. 1.
Figure 4:
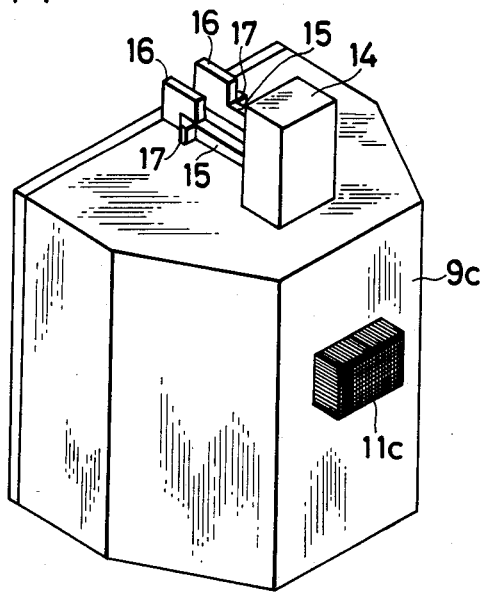
FIG. 4 is an enlarged perspective view of an ink cartridge which is a component of the deive shown in FIG. 1.

The top wall 1 of the casing has four radially disposed slots 12 extending from the outer peripheral edge of the top wall 1 toward the transfer roller 3. The bottom wall 2 has four corresponding slots 13 each located immediately below one of the slots 12. One such slot 13 is shown in FIG. 2. Each of the ink cartridges **9*b*, 9*c*, 9*m* and 9*y* is provided at its top with an upstanding projection 14 extending upwardly through one of the slots 12. Each projection 14 is provided with a pair of parallel elastic levers 15 disposed in the slot 12 and extending toward the outer peripheral edge of the top wall 1. Each lever 15 has an upper surface which is substantially at the same level of height as the upper edge of the slot 12, and a lower surface which lies substantially at one-third of the depth of the slot 12, as shown in FIG. 2. The lever 15 has a free end provided with a projection 16 lying above the slot 12. An external transversely extending projection 17 is provided on the outer surface of the lever 15 in the vicinity of the upstanding projection 16. A pair of mutually facing and confronting projections 18 are formed on the opposite edges of each slot 12 to define a stop for the projections 17 on the levers 15 in the slot 12 when the corresponding ink cartridge is retracted from the transer roller 3. Each projection 18 has an upper surface which is flush with the upper edge of the slot 12, and a lower surface lying at about one-third of the slot depth, as shown in FIG. 3**.

Each ink cartridge is provided at its bottom with a guide projection 19 which is slidable in one of the slots 13, as shown by way of example in FIG. 2. A leaf spring 20 is provided on the radially outer end of each ink cartridge to urge it toward the transfer roller 3. The spring 20 has a lower end secured to the outer surface of the ink cartridge. A pair of mutually facing recesses 22 are formed on the opposite edges of each slot 12 adjacent to the outer peripheral edge of the casing top wall 1. The spring 20 has an upper end engaged in the recesses 22. Each ink cartridge is provided at its outer end with a radially outwardly extending projection 21 intermediate the upper and lower ends thereof. The spring 20 has a midportion which is arcuately curved by the projection 21, as shown in FIG. 2.

In FIG. 1, the ink delivery members **11*b*, 11*c*, 11*m* and 11*y* of all the ink cartridges 9*b*, 9*c*, 9*m* and 9*y* are in contact with the transfer roller 3. If the projection 14 on one of the ink cartridges, for example, the ink cartridge 9*c*, is pulled by a finger against the force of the spring 20, the ink cartridge 9*c* is retracted away from the transfer roller 3 along the slots 12 and 13. The levers 15 move back in the slot 12, and upon abutment on the projections 18, they are elastically deformed in the slot 12. Upon movement of the projections 17 on the levers 15 past the projections 18, the levers 15 restore their original shape and their projections 17 are locked against the projections 18 on the opposite side thereof from the transfer roller 3. The projection 14 can now be released, and the ink cartridge 9*c* is maintained in its retracted position in which its ink delivery member 11*c* is kept away from the ink transfer surface 3*c* of the transfer roller 3. The return of the ink cartridge is effected by depressing the projections 16 on the levers 15. If the projections 16 are depressed, the levers 15 are flexed downwardly, and the projections 17 are lowered from the projections 18. The spring 20 urges the ink cartridge to return to its advanced position as shown in FIGS. 1 and 2. As is obvious from this description, it is necessary that the projections 16 have a sufficient height above the slot 12 to lower the projections 17 to a level below the projections 18 when the projections 16** are depressed.

Although the invention has been described with reference to a multicolor ink ribbon cassette, it is, of course, possible to apply this invention to a singlecolor ink ribbon cassette, too.

What is claimed is:

1. An ink ribbon cassette comprising: a casing having top and bottom walls, a rotatable transfer roller in said casing, an ink cartridge slidably mounted in said casing and movable between an inner position contacting said transfer roller and a retracted position spaced from said transfer roller, a spring urging said ink cartridge toward said inner position, said top wall having a slot extending radially outwardly relative to said transfer roller, means attached to said ink cartridge for moving said cartridge by hand outwardly from said inner position to said retracted position, and a pair of spaced outwardly extending elastic levers attached to said ink cartridge to undergo back and forth movement lengthwise in the top wall slot as said ink cartridge moves back anh forth between its inner and retracted positions each said lever having an external projection extending transversely of the top wall slot and said levers being elastically flexible from their normal unflexed positions toward each other and toward said bottom wall, said top wall slot having on opposite sides thereof a pair of confronting projections effective to elastically flex said levers toward each other during movement of said ink cartridge to said retracted position to thus allow said external projections to slide past said confronting projections and thereafter to return to their normal positions to engage said confronting projections to thereby maintain said ink cartridge in said retracted position, and means for elastically flexing said levers toward said bottom wall to disengage said external projections of said lever from said confronting projections of said slot to thereby permit said spring to slide said ink cartridge to said inner position.

2. An ink ribbon cassette as set forth in claim 1, wherein said bottom wall has a radially extending slot formed immediately below said slot in said top wall, said ink cartridge being provided at its bottom with a projection disposed slidably in said bottom wall slot.

3. A cassette according to claim 1; wherein said means for flexing said levers toward said bottom wall comprises a projection upstanding from each said lever.

4. A cassette according to claim 1; wherein said means for moving said cartridge comprises an upwardly extending projection on said cartridge.

* * * * *